US008757392B2

(12) United States Patent
LaVeine

(10) Patent No.: US 8,757,392 B2
(45) Date of Patent: Jun. 24, 2014

(54) FLEXIBLE MAT SCREENING APPARATUS WITH OFFSET SUPPORTS

(71) Applicant: Action Vibratory Equipment, Inc., Newberg, OR (US)

(72) Inventor: Andrew T. LaVeine, Newberg, OR (US)

(73) Assignee: Action Vibratory Equipment, Inc., Newberg, OR (US)

( * ) Notice: Subject to any disclaimer, the term of this patent is extended or adjusted under 35 U.S.C. 154(b) by 0 days.

(21) Appl. No.: 13/671,385

(22) Filed: Nov. 7, 2012

(65) Prior Publication Data

US 2013/0126398 A1 May 23, 2013

Related U.S. Application Data

(60) Provisional application No. 61/563,175, filed on Nov. 23, 2011.

(51) Int. Cl.
*B07B 1/28* (2006.01)

(52) U.S. Cl.
USPC ..... 209/319; 209/326; 209/399; 209/403; 209/405; 209/408; 209/409; 209/412

(58) Field of Classification Search
USPC ..... 209/319, 326, 399, 403, 405, 408, 409, 209/412, 315
See application file for complete search history.

(56) References Cited

U.S. PATENT DOCUMENTS

| | | | | |
|---|---|---|---|---|
| 1,725,511 A | | 8/1929 | Flanagan | |
| 2,230,321 A | | 2/1941 | Downs | |
| 2,329,773 A | | 9/1943 | Leahy | |
| 2,338,904 A | | 1/1944 | Cowles | |
| 3,219,065 A | | 11/1965 | Moeller | |
| 3,378,142 A | * | 4/1968 | Wehner | 209/325 |
| 3,633,745 A | * | 1/1972 | Wehner | 209/310 |
| 3,647,068 A | * | 3/1972 | Wehner | 209/310 |
| 3,971,715 A | | 7/1976 | Wehner | |
| 4,064,051 A | | 12/1977 | Wehner | |
| 4,188,288 A | | 2/1980 | Wehner | |
| 4,248,701 A | | 2/1981 | Wenzel | |

(Continued)

FOREIGN PATENT DOCUMENTS

| | | |
|---|---|---|
| AT | 0002993 | 12/1900 |
| AT | 0386137 | 7/1988 |

(Continued)

OTHER PUBLICATIONS

Photographs (five) of Bivi-TEC vibratory screening machine, Aggregates Equipment, Inc., machine Serial No. 2008 (photographs taken Jan. 2007).

(Continued)

*Primary Examiner* — Kaitlin Joerger
(74) *Attorney, Agent, or Firm* — Stoel Rives LLP; John A. Rafter, Jr.

(57) ABSTRACT

Mechanical separators and screening machines, and methods for flexible sieve mat screening are disclosed. In an example configuration, a flip-flow type flexible mat screening apparatus is provided with optimized relative elevation positions for adjacent pairs of first and second mat supports. In one configuration, a portion of the first mat supports is arranged at a lowered or offset position relative to adjacent second mat supports.

27 Claims, 9 Drawing Sheets

(56) References Cited

U.S. PATENT DOCUMENTS

| | | | | |
|---|---|---|---|---|
| 4,482,046 | A | 11/1984 | Kraus | |
| 4,632,751 | A | 12/1986 | Johnson et al. | |
| 4,670,136 | A | 6/1987 | Schmidt | |
| 4,819,810 | A | 4/1989 | Hoppe | |
| 5,037,536 | A | 8/1991 | Koch et al. | |
| 5,051,170 | A | 9/1991 | Ahorner | |
| 5,062,949 | A | 11/1991 | Hausmann | |
| 5,595,306 | A | 1/1997 | Hukki et al. | |
| 5,613,613 | A | 3/1997 | Ahorner | |
| 5,746,322 | A | 5/1998 | LaVeine et al. | |
| 5,749,471 | A | 5/1998 | Andersson | |
| 5,816,413 | A | 10/1998 | Boccabella et al. | |
| 5,944,170 | A | 8/1999 | LaVeine et al. | |
| 6,179,128 | B1 | 1/2001 | Seyffert | |
| 6,253,926 | B1 | 7/2001 | Woodgate | |
| 6,537,148 | B2 | 3/2003 | Schwersmann | |
| 6,575,304 | B2 | 6/2003 | Cudahy | |
| 6,659,286 | B2 | 12/2003 | Seyffert et al. | |
| 7,114,620 | B2 * | 10/2006 | Anibas | 209/319 |
| 7,175,027 | B2 | 2/2007 | Strong et al. | |
| 7,344,032 | B2 | 3/2008 | LaVeine et al. | |
| 7,654,394 | B2 | 2/2010 | LaVeine et al. | |
| 2002/0195377 | A1 | 12/2002 | Trench et al. | |
| 2005/0016901 | A1 | 1/2005 | Eeles et al. | |
| 2007/0068852 | A1 | 3/2007 | Lease et al. | |

FOREIGN PATENT DOCUMENTS

| | | | |
|---|---|---|---|
| AT | 0387342 | | 1/1989 |
| DE | 2108924 | | 9/1972 |
| DE | 3139279 | A1 | 4/1983 |
| DE | 3521753 | A1 | 12/1986 |
| EP | 0209777 | B1 | 7/1986 |

OTHER PUBLICATIONS

Instruction Manual and Parts List for Bivi-TEC KRL/ED 2400×7M OX 15°-20° "Patented Oscillation Incline Screen" (Jul. 2000).

The Liwell Screen, Hein, Lehmann US LLC, advertisement in Aggregates Manager (Jan. 2007, p. 15).

Pages from Hein, Lehmann website, Liwell KT vibratory screening machine, http://www.liwell.com (visited Feb. 1, 2007).

M.A. Short, Hein, Lehmann US LLC "Flip Flow Screen—Technology for Dry Screening" (no date).

Westerkamp et al., "Solutions for Screening Problematic Materials" Aufbereitungs-Technik 38(7), 349-357 (1997).

W. Hirsch, "Flip-Flow Screens of the Third Generation" Aufbereitungs-Technik 33(12), 686-690 (1992).

Derrick Corporation, "Dry Screening Technology" Brochure (Feb. 2003) http://www.derrickcorp.com/Images/Documents/DryScreening.pdf (Visited Sep. 5, 2013).

Tema Isenmann, Inc., "Industrial Screening Systems" Brochure (1993).

IFE Material Handling, "Double Deck Trisomat" Brochure (Jan. 1998).

IFE Trisomat Flip Flow Screening Machine http://www.invercas.cl/pdf/IFE-Trisomat-Flip-Flop.pdf (Visited Sep. 5, 2013).

Binder & Co., website, http://www.binder-co.com/index_en_2_2_1_3_1.html visited Oct. 2004.

Binder & Co., "Bivitec Binder Vibration Technology" Brochure, undated, downloaded from http://www.binder-co.com/pdfs_en/BIVITEC_eng.pdf, visited 2004.

Binder & Co., "Processing Technology" Brochure, undated, downloaded from http://www.binder-co.com/pdfs_en/konvsieb_en.pdf , visited 2004.

Hein, Lehmann, "One Screening Concept, Many Applications" Brochure, undated, downloaded from http://heinlehmann.de, visited 2004.

Liwell Flip Flow Screens, 1999, http://www.heinlehmann.de/page2-4.htm, visited May 24, 2004 (two pages).

Jost GmbH & Co. KG, "Vibrating Screens" Brochure (Mar. 2001) (six pages).

Jost GmbH & Co. KG, "Flip-Flop Screen Trampolin" Brochure, (approx. 2004) (five pages).

Binder & Co., "Binder & Co. Screening Technology," Successful Internationally and at home (4 pages) (issue Mar. 2004).

Brochure: Urbar Ingenieros S.A., "The BiviTEC screen" (Apr. 2002).

Binder & Co., "Special Screen BiviTEC principle" from http://www.binder-co.com/index_en_2_2_1_3_1.html (visited Oct. 14, 2004) (2 pages).

Brochure: Polyurethane screen decks, Eurogomma (Bergamo, Italy), downloaded from: http://www.eurogomma.net/flipflow.pdf (no date), visited Nov. 8, 2007.

Slide Show—Bevcon Wayors Pvt Ltd, "Technologies for Future—'Straflex' Flip Flow Vibrating Screens", downloaded from: http://www.greenbusinesscentre.org/grn/mmbase/attachments/490/FlipFlowScreens_Bevcon-Ratul_Chakraborthy.pdf (no date), visited Nov. 27, 2007.

Gummi Kuper "Flexible and wear-resistant Screen panels" downloaded from: http://www.gummi-kueper.de/pics/pdf/Prospekt%20Siebbel%E4ge%20e.pdf (no date), visited Nov. 27, 2007.

Binder+Co Bivitec Difficult to screen materials downloaded from: http://www.binder-co.com/en/Downloadbereich/BIVITEC_engl_1204.pdf visited Aug. 13, 2009.

Slide Show Bivi-TEC Screen downloaded from: http://ceramicartdaily.net/postmeeting/structural_clay/Stairs.pdf visited Aug. 11, 2009.

Brochure Action Equipment Vibra-Snap® Screen (four pages) (about 2009).

* cited by examiner

LINEAR CARRIER SUPPORT ARRANGEMENT AT 15.0° DECLINE

DECLINING SLOPE WITH OFFSET CARRIERS

COMBINATION OFFSET AND NON-OFFSET CARRIER SUPPORTS WITH DECLINING SLOPE

FLEXIBLE MAT SCREENING APPARATUS WITH OFFSET SUPPORTS

RELATED APPLICATION DATA

This application claims priority under 35 U.S.C. 119(e) to provisional application No. 61/563,175 filed Nov. 23, 2011, hereby incorporated by reference.

BACKGROUND

The field of the present disclosure relates to vibratory screening machines and conveyors using flexible mats.

Various designs have been proposed for sieve mat screening machines. One prior screening machine has an elongated support frame with a mobile, deformable sieve mat, typically comprised of a plurality of sieve mat sections and a series of alternating first and second sieve mat supports mounted on the support frame and extending transversely along the length thereof, the sieve mat sections being affixed to a pair of the first and second mat supports with the mat supports being movable with respect to each other in the direction of the length of the support frame. During cycling of the screening machine, the individual screen mat sections are alternately tensioned and relaxed creating a high-acceleration trampoline effect. For the purposes of this description, this machine is referred to as a flip-flow type screening machine. Certain flip-flow machines are described in LaVeine et al U.S. Pat. Nos. 7,654,394 and 7,344,032.

The present inventor has recognized potential for improvements to the prior sieve mat screening machines.

SUMMARY

The present disclosure is directed to mechanical separators and screening machines or more particularly to designs and methods for flexible sieve mat screening. A preferred configuration is directed to a flip-flow type flexible mat screening apparatus that is provided with optimized height/slope arrangements of its mat carrier supports.

DETAILED DESCRIPTION OF PREFERRED EMBODIMENTS

With reference to the above-listed drawings, this section describes particular embodiments and their detailed construction and operation. To facilitate description, any element numeral representing an element in one figure will be used to represent the same element when used in any other figure. The embodiments described herein are set forth by way of illustration only and not limitation. It should be recognized in light of the teachings herein that there is a range of equivalents to the example embodiments described herein. Notably, other embodiments are possible, variations can be made to the embodiments described herein, and there may be equivalents to the components, parts, or steps that make up or augment the described embodiments.

Figure 1:
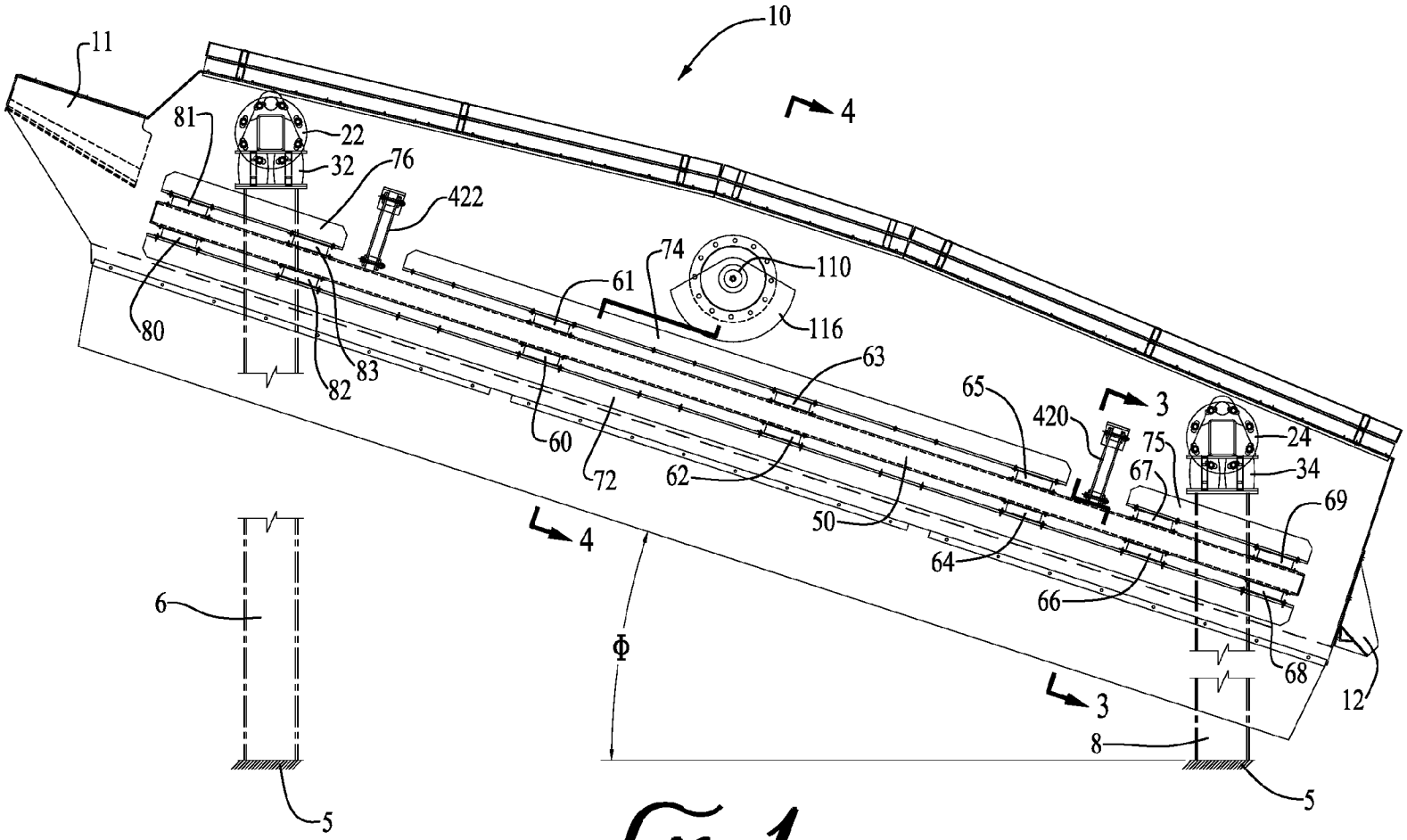
FIG. 1 is a front side view of a flip-flow screening apparatus according to a preferred embodiment.
Figure 2:
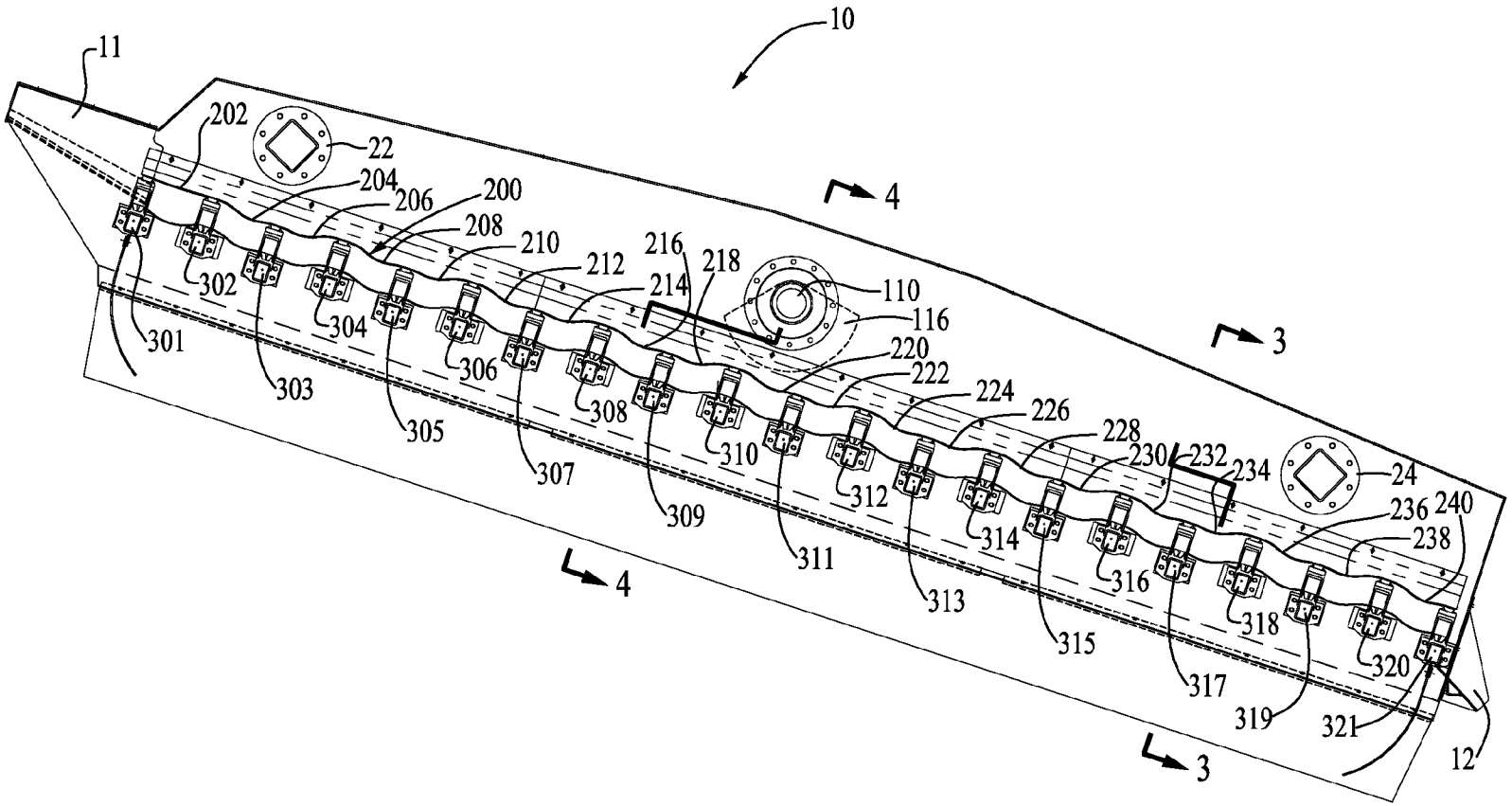
FIG. 2 is a diagrammatic cross-sectional side view of the apparatus of FIG. 1 (without showing the balancer assembly or balancer carrier support) showing additional details of the mat and carrier supports, and illustrating the frame carrier supports in an offset configuration according to a first embodiment.
Figure 3:
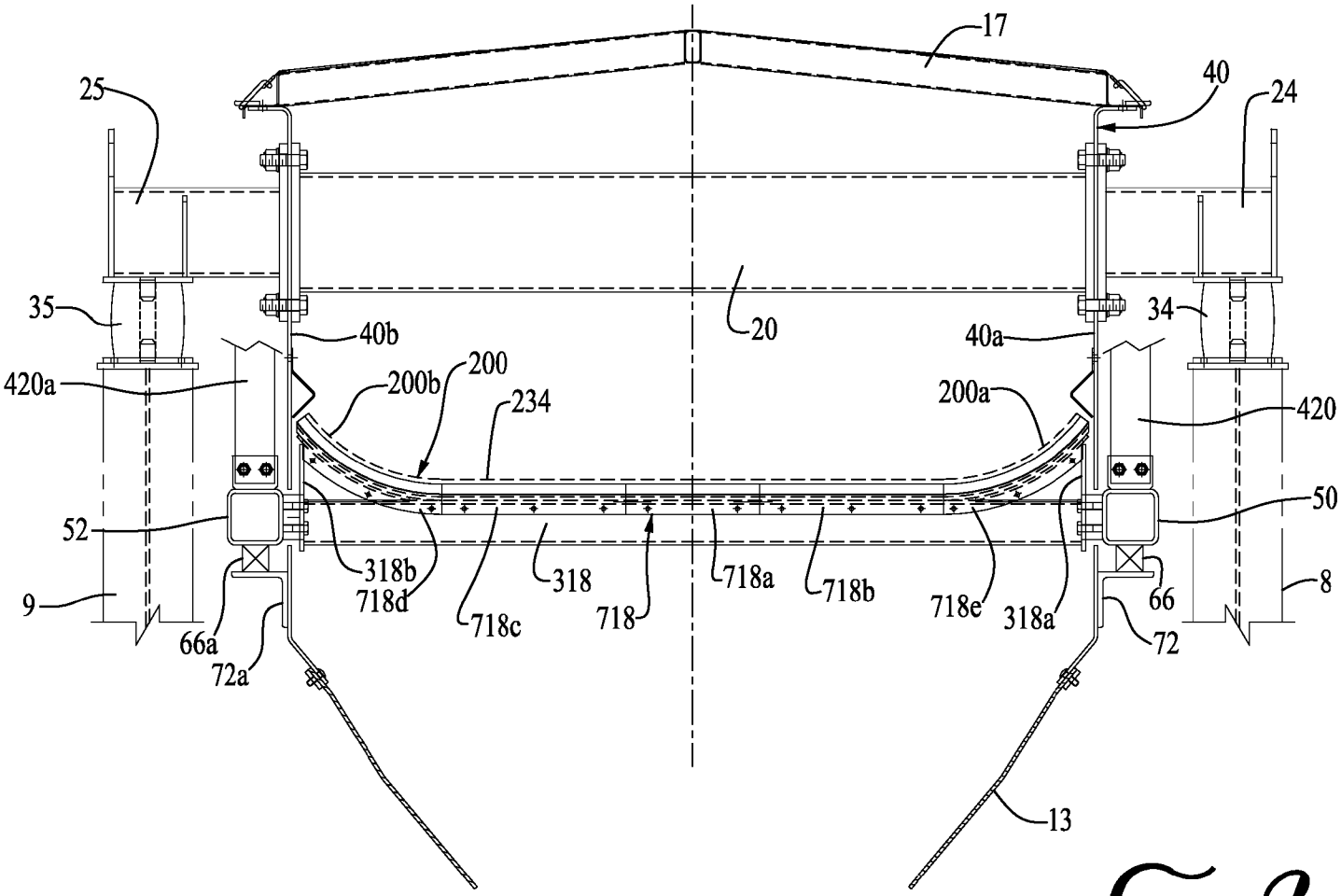
FIG. 3 is a cross-sectional view of the apparatus of FIG. 1 taken along line 3-3 and showing the isolation mounts and balancer carrier support (the cross-section location also being diagrammatically shown in FIG. 2).

FIGS. 1-4 illustrate a screening machine 10 according to a first embodiment. The screening machine 10 includes a first support frame 40 which is supported on a base of outer supports onto a foundation 5 (ground) via a plurality of mounts, each mount being supported on a corresponding isolation spring. The screening machine of FIG. 1 is illustrated with four mounts and four corresponding outer supports, but other suitable numbers of mounts may be implemented. The side elevation view of FIG. 1 shows mount 22 (right side upper mount) on isolation spring 32 on outer support 6 and mount 24 (right side lower mount) on isolation spring 34 on outer support 8. Though not visible in FIG. 1, the other pair of corresponding mounts (left side upper and left side lower) and isolation springs are symmetrically disposed on the opposite side of the support frame 40. As to those other mounts, it is noted that FIG. 3 illustrates right side lower mount 24 supported on isolation spring 34 on right side of the support frame 40 and left side lower mount 25 supported on isolation spring 35 on outer support 9 on the left side. As further shown in FIG. 3, the support frame sides 40*a* and 40*b* are interconnected by a connecting member or frame element 20 extending between the support frame sides 40*a* and 40*b* and between the mounts 24 and 25. The connecting member 20 provides for stiffening connection between the support frame sides 40*a* and 40*b*.

For the purposes of description herein, vertical and horizontal will at times be described relative to the main plane of the sieve mat (i.e., the screening deck). The screening deck is illustrated as being mounted and configured on a general declination angle ϕ to the ground (see FIG. 1) on the order of 5° to 30°, preferably on the order of 15° to 18° (as shown in FIGS. 1-2). This general declination angle ϕ for an overall path of the sieve mat 200 screening deck provides a downward sloped or downhill path which, combined with the vibration drive, conveys material down the sieve mat 200. Though these ranges for the declination angle ϕ are preferred examples, the machine may be oriented at any suitable declination angle. This declination angle ϕ is best viewed in FIG. 1 wherein mounts 22 and 24 are shown at an angle ϕ to the ground via the isolation springs 32 and 34. The isolation spring mounts 22/32 and 24/34 etc. may be adjustable to adjust the declination angle ϕ or provide for a multi-slope profile. Alternately, the declination angle of the sieve mat 200 may change over the length of the unit, the actual mounting of the sieve mat 200 providing the desired declination angle(s). For example the declination angle of the sieve mat 200 may decrease either continuously or in stages/steps. For example, the declination angle of the sieve mat 200 at the first sieve mat section 202 may be at 20° and decrease to 15° or 10° at the last mat section 240. A continuously decreasing "banana" type declination may provide operational, efficiency and/or wear advantages and potentially decrease the overall machine footprint.

In this regard, there may be described two types or categories of screening decks for flip-flow machines: flat deck machines and curved deck machines. The flat deck machines (such as the machines in FIGS. 2-8) are characterized by the mat/carrier supports being arranged in a flat plane. Curved deck machines (such as the machines in FIGS. 9-10) have carrier supports that are arranged along a curved plane, with the curve being continuous (as shown in FIG. 9) or stepped whereby adjacent flat deck sections are arranged at declining declination angles to one another traversing from the inlet end to the discharge end.

The unit 10 includes an external support frame system with interconnected right and left side sections, the right side section of the frame system being visible in FIG. 1. The right side section of the frame system comprises a lower rail 72 (in the form of angle iron) and a three section upper rail 74, 75, 76 (each also in the form of an angle iron. The lower and upper rails support a balancer rail 50 suspended between (a) a lower set of shear blocks 80, 82, 60, 62, 64, 66 and 68 and (b) an upper set of shear blocks 81, 83, 61, 63, 65, 67 and 69. The left side section of the frame system is of a same (mirror image) configuration, which though not visible in FIG. 1 has several elements illustrated in FIGS. 3-4 including lower rail 72*a* (in the form of an angle iron) and upper rail section 74*a* (of the left side three section upper rail, each also in the form of an angle iron). The left side lower and upper rails support a left side balancer rail 52 suspended between corresponding sets of spring mounts or shear blocks (left side shear blocks 62*a*, 63*a* being visible in FIG. 4 and left side shear block 66*a* being visible in FIG. 3).

Figure 4:
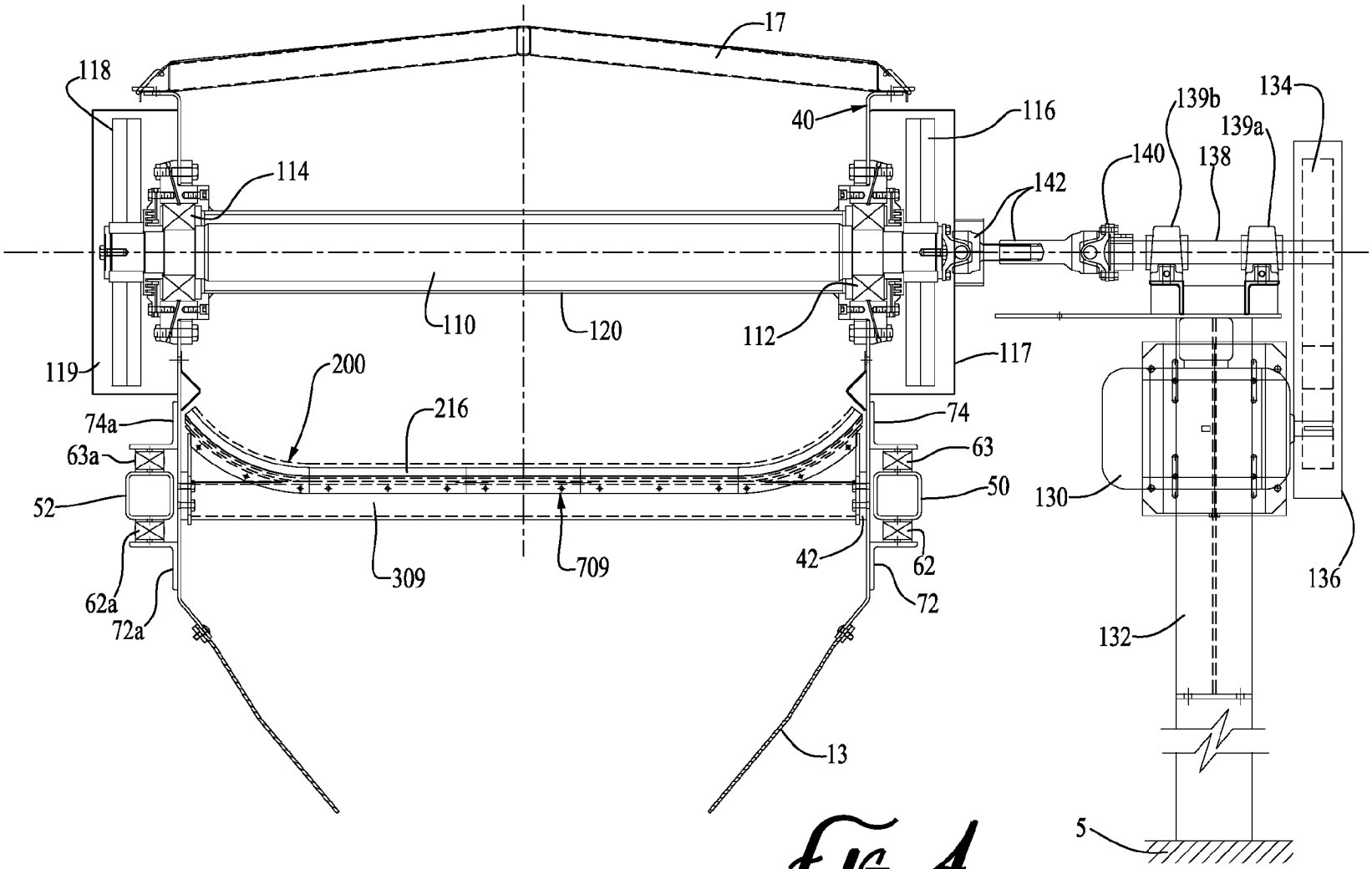
FIG. 4 is a cross-sectional view of the apparatus of FIG. 1 taken along line 4-4 and showing the eccentric drive and frame carrier support (the cross-section location also being diagrammatically shown in FIG. 2).

As shown in FIGS. 1, 2 and 4, a drive shaft 110 is supported and mounted by bearings 112, 114 which are in turn mounted onto the main support frame 40. As the shaft 110 is rotationally driven by the drive motor 130, a vibrating or orbital motion is applied by the eccentrics 116 and 118 disposed on opposite ends of the shaft 110. The vibrating motion applied by the rotating eccentrics is transferred to the main support frame 40 via the shaft 110 through the bearings 112, 114. Safety guarding 119 is disposed over the eccentric 118 and left side drive end; and safety guarding 117 is disposed over the eccentric 116 and right side drive end. The safety guarding 119, 117 surround and prevent/inhibit access to the moving parts. Other guarding or covers may be provided around other moving components if desired. The drive motor 130 is mounted/supported on mount structure 132 to the ground/foundation 5. The motor 130 drives/rotates a jack shaft 138 via a drive belt 134 (e.g., a toothed or sprocket-type belt). Alternate drive transmissions such as a chain drive, direct gear drive or other suitable drives may be employed. The jack shaft 138 is rotationally supported via bearings 139*a*, 139*b* and then connected via a U-joint 140 and spline connection 142 to the drive shaft 110 (passing through the cover 117).

Other suitable vibration application systems may be utilized such as a type that applies varying horizontal and/or vertical stroke components. The shaft 110 is illustrated as an internal shaft of suitable diameter passing through the bearings 112, 114 and extending out through the entire width of the frame assembly 40. The shaft 110 is surrounded by an external pipe 120 (of suitable internal diameter that is larger than the external diameter of the shaft 110) which extends between the mountings of the bearings 112, 114. The pipe 120 has end flanges which secure the pipe to the side frame assembly at the mounts for the bearings 112, 114. The pipe 120 provides for lateral support and stiffening between the bearing shaft mounts. The eccentrics 116, 118 on opposite sides of the shaft 110 are preferably located at the same angular position relative to the shaft 110 so as to provide a balanced application of the vibration force from the shaft 110 through the bearings 112, 114 and into both sides of the frame assembly 40. The drive shaft 110 may be positioned near the machine center of gravity or at some other suitable location.

The drive shaft 110 disclosed above is just one type of suitable drive mechanism. For example, the drive mechanism may comprise a single drive shaft 110 or may comprise multiple shafts driven by one or more drive motors.

The sieve mat 200 extends longitudinally across the length of the screening apparatus 10 from the inlet side section 11 (shown at the upper left hand side of FIG. 1) to the outlet side section 12 (shown at the lower right hand side of FIG. 1). Though the sieve mat 200 may comprise a single piece of material, the sieve mat 200 in one embodiment is comprised of a series of removable transverse mat sections or strips 202, 204, 206, 208, 210 . . . 240 with each mat section being supported by an adjacent pair of transverse mat supports 301, 302, 303, 304, 305 . . . 321 (namely a first mat support and a second mat support). Specifically, sieve mat section 202 is supported between first mat support 301 and second mat support 302; sieve mat section 204 is supported between second mat support 302 and first mat support 303; sieve mat section 206 is supported between first mat support 303 and second mat support 304, etc. In the illustrated example, the sieve mat supports are in the form of square or rectangular tubes disposed below the mat 200, and thus may be referred to as tubes or carrier tubes. Though the illustrated square tube configuration provides a desirably high strength and stiffness to weight ratio, other shapes and orientations for the mat supports may be utilized.

The sieve mat supports 301, 302, etc. are alternately connected to either the main support frame section 40 or the balancer support 50. Thus a plurality of first mat supports (i.e., the frame tube supports 301, 303, 305 . . . 321) are connected to the main support frame section and are vibrated directly by the action of the eccentrics 116, 118; and a plurality of second mat supports (i.e., the balancer tube supports 302, 304, 306 . . . 320) are connected to the balancer rail 50 and thus are free to move relative to the frame tube supports (and thus relative to the main support frame section 40). The balancer rail 50 is supported via the vertical stabilizers 420, 420*a* and the shear blocks (described above), the shear blocks permitting movement of the balancer tube supports. For example, as shown in FIGS. 2 and 4, the mat section 216 is connected on the upstream end to frame tube support 308 and on the downstream end to balancer tube 309; and as shown in FIGS. 2-3, the mat section 234 is connected on the upstream end to frame tube 317 and on the downstream end to balancer tube 318. The operative functions of these connections will be described in further detail below.

It is noted that in the example of FIGS. 1-4 the uppermost (upstream) carrier tube 301 is a frame tube and the lowest (downstream) carrier tube 321 is also a frame tube, but other configurations are possible such as starting and/or ending with a balancer tube.

Each of the frame tube support assemblies 301, 303, 305 . . . 321 has essentially the same configuration and the description of one of the tubes should provide adequate description for any of the other frame tube assemblies. Each of the moving balancer tube assemblies 302, 304, 306 . . . 320 has essentially the same configuration and the description of one of the tubes should provide adequate description for any of the other balancer tube assemblies. FIG. 4 illustrates a detailed cross-section of FIG. 1 taken along line 4-4 (also shown diagrammatically by line 4-4 in FIG. 2) whereby a frame tube assembly 309 is supported directly to the main support frame section 40 via connector 42. Though a bolted connection is illustrated, other connection mechanisms may be used such as through bolt and nut, welding, rivet, or any suitable fastener.

The shear blocks may be comprised of any suitable resilient material of any durometer, such as rubber or polyurethane or other elastomeric material. The shear blocks may be formed and arranged to permit motion in the desired direction and may optionally provide a spring force (rate) for that desired motion. Though the shear spring mounts, typically made of an elastomeric material, are one suitable type of mount, other mounting mechanisms may be employed such as coil or leaf (metal) springs, torsion rods or other suitable mechanism(s).

The sections 202, 204, 206, etc. of the frame mat are transversely connected to the respective frame tube or balancer tube along the length of the mat 200. Any suitable attachment scheme may be used such as directly bolted systems or boltless plug systems. Though the clamping components may be made of any suitable material (e.g., stainless steel, mild steel), one preferred mat connection system is the plastic clamp bar assemblies 718 (in FIG. 3) and 709 (in FIG. 4). Further details of the clamp bar assembly design are disclosed in U.S. Pat. No. 7,654,394, hereby incorporated by reference. The balancer tube 318 includes a clamp bar assembly 718 that is attached to the tube 318 via bolts on opposite sides of the tube, and the frame tube 317 includes a clamp bar assembly that is attached to the tube 317. The clamp bar assemblies and the mechanisms for clamping the edges of the mat sections thereto are the same for both frame tubes and balancer tubes, though different mechanisms may be employed and only the clamp bar assembly 718 will be described and should be understood to apply to the clamp bar assembly on the frame tube 317 or clamp bar assembly 709 on frame tube 308 illustrated in FIG. 4.

The clamp bar assembly 718 may be formed in a single piece, but the assembly is preferably formed in a plurality of sections 718*a*, 718*b*, 718*c*, 718*d*, 718*e*. End clamp bar sections 718*d*, 718*e* are curved sections, while sections 718*a*, 718*b*, 718*c* are straight sections. The curved clamp bar sections 718*d*, 718*e* are connected to respective gussets 318*a*, 318*b* attached to the balancer tube 318 providing a curved spacer for supporting the curved clamp bar end sections. Similarly, the clamp bar assembly connected to the frame tube 308 has straight and curved sections. Other types of flip-flow mat configurations may be utilized such as one without the upwardly-curved side sections.

The motion of balancer rails 50, and correspondingly the balancer tubes 304, 308, 312 . . . 340, may be restrained by operation of optional vertical stabilizers 420, 420*a*, 422 (the fourth vertical stabilizer is not shown but is symmetrically placed relative to the other three stabilizers). The vertical stabilizers connect between the balancer 50 and an upper section 40*b* of the main frame 40. Similar stabilizers are disposed on the other side of the unit 10. The vertical stabilizers may be constructed of single or multiple layers of any suitable material such as metal (e.g., spring steel or other steel alloy), fiberglass, or a composite material.

Both the vertical stabilizers and the shear blocks may serve to minimize lateral movement which in turn may reduce fatigue/wear on the sieve mat. Minimizing lateral movement is particularly useful in reducing fatigue/wear at the curvature areas (such as the screen mat curvature areas or the arcuate screen side sealing areas). By constraining the movement of the balancer, a consistent stroke may be achieved thereby enhancing component life and screening efficiency.

Thus when the frame assembly section 40 is driven via the eccentric drive mechanism 110/116, the frame section 40 is driven in an orbital or other vibrating pattern as permitted by the isolation springs 32, 34, 36. The balancer tube supports 302, 304, 306 . . . 320 mounted on the balancer 50 have the flexibility to move longitudinally relative to the frame tube supports 301, 303, 305 . . . 321 via the shear spring mounts 60 and the (optional) vertical stabilizers 420, etc. Thus, during operation, the distance between adjacent tubes alternately increases and decreases, alternately flexing and unflexing the mat section therebetween. The magnitude of relative movement between the supports depends on several factors including, the overall machine design (e.g., single- or multi-deck) and frame size/geometry, the design/size of the vibrating drive, and flexibility of the springs.

In the above-described drive configuration having the frame tubes 301, 303, etc. fixedly mounted to the frame section 40 and vibrationally driven therewith, and the balancer tubes 302, 304, etc. movably mounted to the frame section 40, the movably mounted balancer tubes undergo what may be described as a sympathetic motion such that their stroke/vibrational movement is significantly higher than the stroke of the frame tubes. Other types of drive configurations may be envisioned. For example, both the first carrier supports and the second carrier supports may be actively driven either by a common drive (such as via a suitable gear connection) or by separate drives with the first carrier supports driven by a first drive system at a first vibrational stroke and the second carrier support driven by a separate second drive system at a second vibrational stroke.

The sieve mat 200 may comprise a continuous unit for the various mat sections 202, 204, 206, etc. or may comprise separate transverse sections of a given length secured at each carrier support assembly via one of the connection assemblies described herein or via some other suitable connection mechanism such as a glued connection. There are advantages for each of the sieve mat sections 202, 204, 206, etc. to be a separate piece, but other types of mat sections may be employed. A mat configuration with separate sections may permit simplified replacement of a single section, such as section 204 or section 206, thereby enabling replacement or repair without requiring replacement of remaining sieve mat sections such as sections 208, 210, etc., or without requiring cutting out and splicing in a replacement section.

The sieve mat may be formed of any suitable material which has the desirable properties of flexibility and strength in addition to abrasion, rust and corrosion resistance depending upon the particular application. For example, the material used for the sieve mats is mechanically strong, such as a resilient elastomer with a balanced range of properties which is able to withstand deformation without loss of elasticity or dimensional accuracy. One such material is a resilient flexible polymer such as polyurethane for example. The sieve mats may be of any suitable construction, such as: single homogenous material construction; a multiple material construction such as one with reinforcements such as internal cables or bars; or multiple layer construction such as one with a suitable screen backing or other layer(s).

The motion of the sieve mat sections is such that in the un-flexed condition (with adjacent carrier supports in the nearer position to each other), a sag or drape will be formed. Then moving to the flexed condition (with adjacent carrier supports moved to the more distant position to each other), the mat section will be snapped toward a flatter/straighter form. This motion is akin to holding a piece of paper, forming a drape, and then in a quick motion pulling taught. Referred to as a flip flow method, during the cycling of the screening machine, the flexible mat sections are individually tensioned and relaxed which breaks or loosens the adhesive bond between materials and between the material and the sieve mats. In the upstroke, material is impelled upwardly functioning much like a trampoline and air is drawn into and through the material. The motion is such that in an example screening machine, the acceleration on the main support frame is about 3 g's, but the material on the sieve mat may experience up to about 50 g's. Sieve mat flexing may also stretch or bend the mat perforations helping to release particles that might become lodged in the perforations, a process called "breathing." The flip flow method is useful for screening a wide variety of materials, such as recycling (auto shredder residue, crushed glass, food scraps, compost, etc.); sorting wood products (wood chips, sawdust, wood pulp); removing abrasive fines from boiler fuel; mineral processing and quarrying applications (sand, ore, excavated soils, etc.); and other applications. The flip-flow machine may be particularly useful for the more difficult applications such as:

screening of moist, sticky, wet and fibrous materials,
screening of small particles,
screening of materials with a high percentage of fines,
screening of near size particles.

The sieve mat 200 has perforations (of desired shapes, sizes and arrangements), but the particular sieve mat sections 202, 204 . . . 240, etc. need not all have such perforations. For example, sieve mat sections 202, 240 being at the respective inlet and outlet ends may be non-perforated.

Before turning to the remaining figures, it is noted that the balancer tubes being supported by the balancer rails move/vibrate at a significantly larger stroke (relative to ground) than the stroke of the frame tubes. The present inventor has observed the tendency of material to collect (i.e., stack up) at the approach of the frame tubes of certain flip-flow systems.

Figure 5:
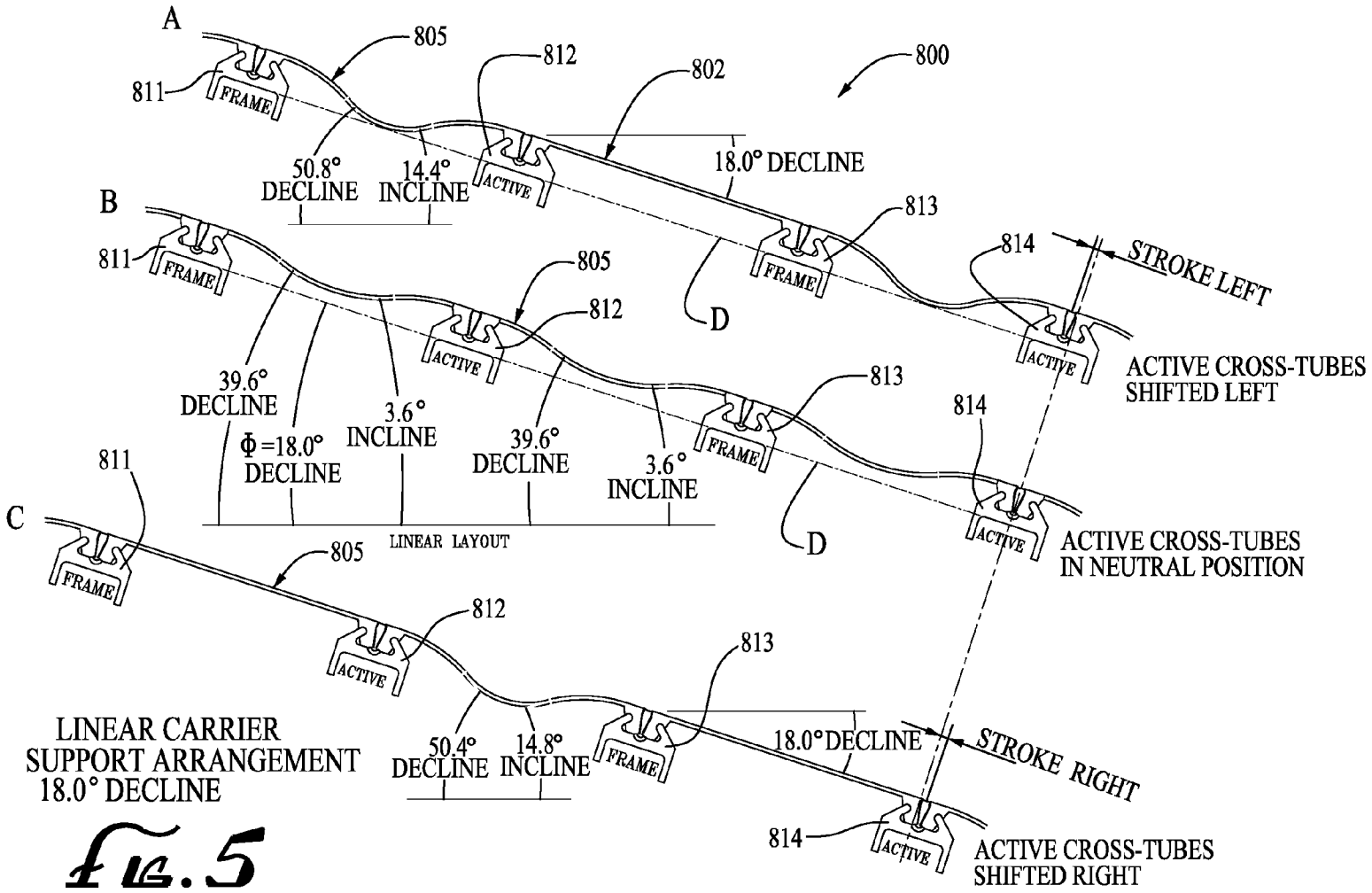
FIG. 5 is a schematic side view of a portion of the flip-flow screen and screen carrier supports, illustrating three positions of the active balancer supports, the carrier supports being in a planar/linear arrangement, the screen being arranged at an 18 degree decline.

FIG. 5 illustrates a flat deck system with non-offset carrier supports whereby the arrangement 800 of the frame tubes and the balancer tubes is in a flat plane (i.e., straight linear), that is, all of the support tubes (both frame tubes 811, 813 and balancer tubes 812, 814) are arranged along the same 18° decline D. FIG. 5 shows three flex positions (A, B and C) for a sieve mat 802. In position B, the balancer (active) tubes 812, 814 are in a neutral or more central position; thus each mat section is in a sagging condition, forming about a 3.6° incline approaching either the frame tubes 811, 813 or the balancer (active) tubes 812, 814. In position A, the balancer (active) tubes 812, 814 are shifted left creating about a 14.4° incline to the balancer tubes and an 18° decline to the frame tubes 811, 813. In position C, the balancer tubes 812, 814 are shown shifted right creating about a 14.8° incline to the frame tubes 811, 813 and an 18° decline to the balancer tubes 812, 814.

The present inventor has posited that this high 14.8° incline to the frame tube, in combination with the frame tube's relatively small stroke (relative to ground), causes the slowing of material at the frame tubes resulting in increased material burden depth, where the same slowing or increased burden depth does not appear at the balancer tubes because the balancer tubes are more active, i.e., they have a higher vibration/stroke.

Figure 6:
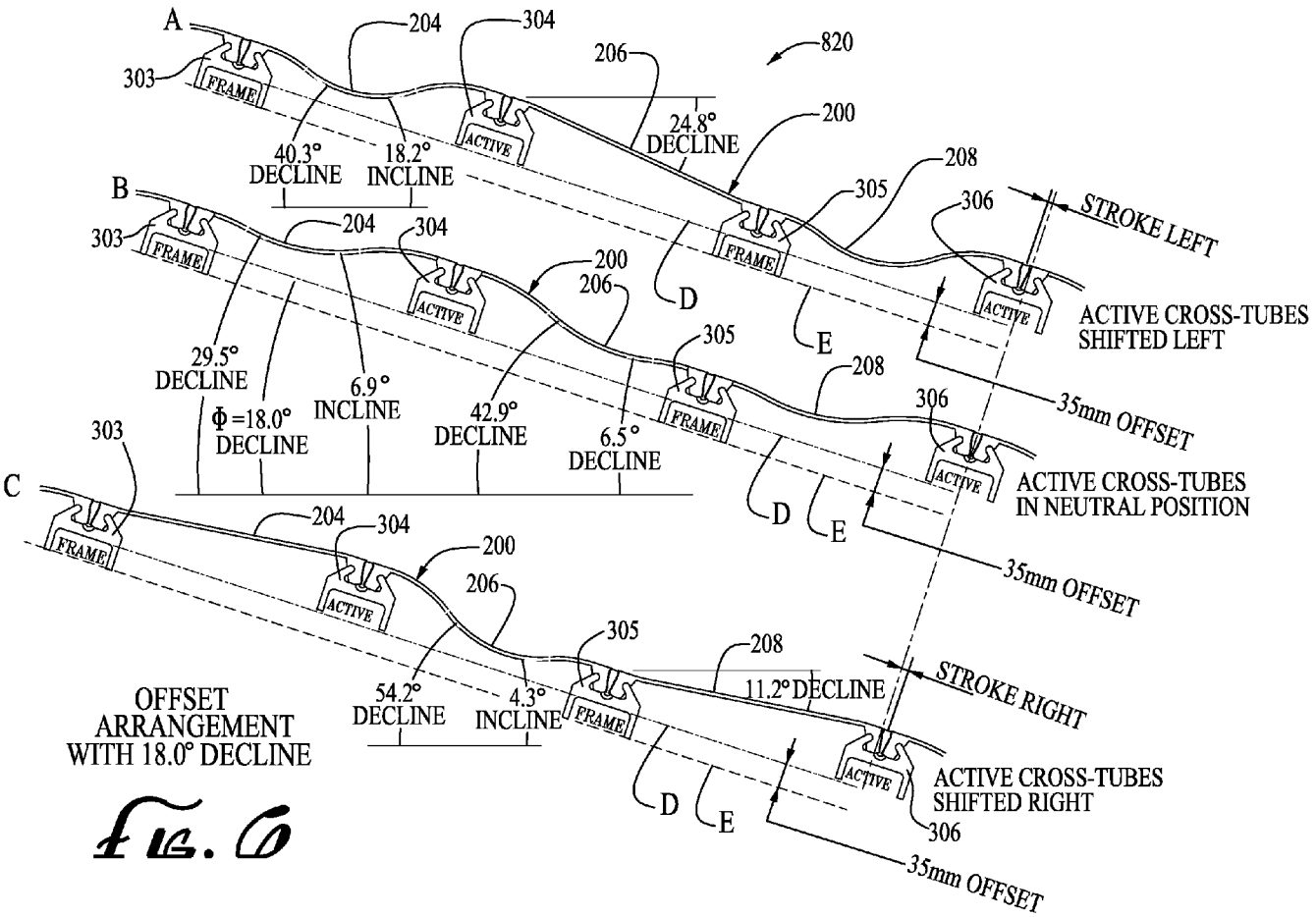
FIG. 6 is a schematic side view of a portion of a flip-flow screen and screen carrier support arrangement according to a first embodiment, illustrating three positions of the active balancer supports, the active balancer supports being in an offset arrangement from the frame carrier supports, the screen being arranged at an 18 degree decline.

Thus to compensate, FIG. 6 illustrates a modified carrier tube configuration 820 according to a first embodiment with offset cross tubes. The arrangement 820 also has a general 18° decline D for the balancer tubes 304, 306, but the frame tubes 303, 305 are downwardly offset by about 35 mm along a parallel 18° decline E below the decline D of the balancer tubes 304, 306. FIG. 6 shows three flex positions (A, B and C) for the sieve mat 200 (and the respective sieve mat sections 204, 206, 208). In position B, the balancer (active) tubes 304, 306 are in a neutral or more central position, thus each mat sections 204, 206, 208 are in a sagging condition, but the angle approaching the frame tubes 303, 305 is a 6.5° decline (as compared to a 3.6° incline to the frame tube in the non-offset configuration 800 of FIG. 5); and the angle approaching the balancer tubes 304, 306 is a 6.9° incline (as compared to the 3.6° incline to the balancer tube in the non-offset configuration 800 of FIG. 5). In position A, the balancer (active) tubes are shifted left, then the mat section 206 is stretched flat with an angle approaching the frame tube 305 is at a 24.8° decline (as compared to an 18° decline to the frame tube in the non-offset configuration 800 of FIG. 5); and the angle approaching the balancer tubes 304, 306 is at an 18.2° incline (as compared to the 14.4° incline to the balancer tube in the non-offset configuration 800 of FIG. 5). In position C, the balancer tubes 304, 306 are shown shifted right then the mat sections 204, 208 are stretched flat with an angle approaching the frame tube 305 is at a 4.3° incline (as compared to a 14.8° incline to the frame tube in the non-offset configuration 800 of FIG. 5), and the angle approaching the balancer tubes 304, 306 is at an 11.2° decline (as compared to the 18° decline to the balancer tube in the non-offset configuration 800 of FIG. 5).

Figure 7:
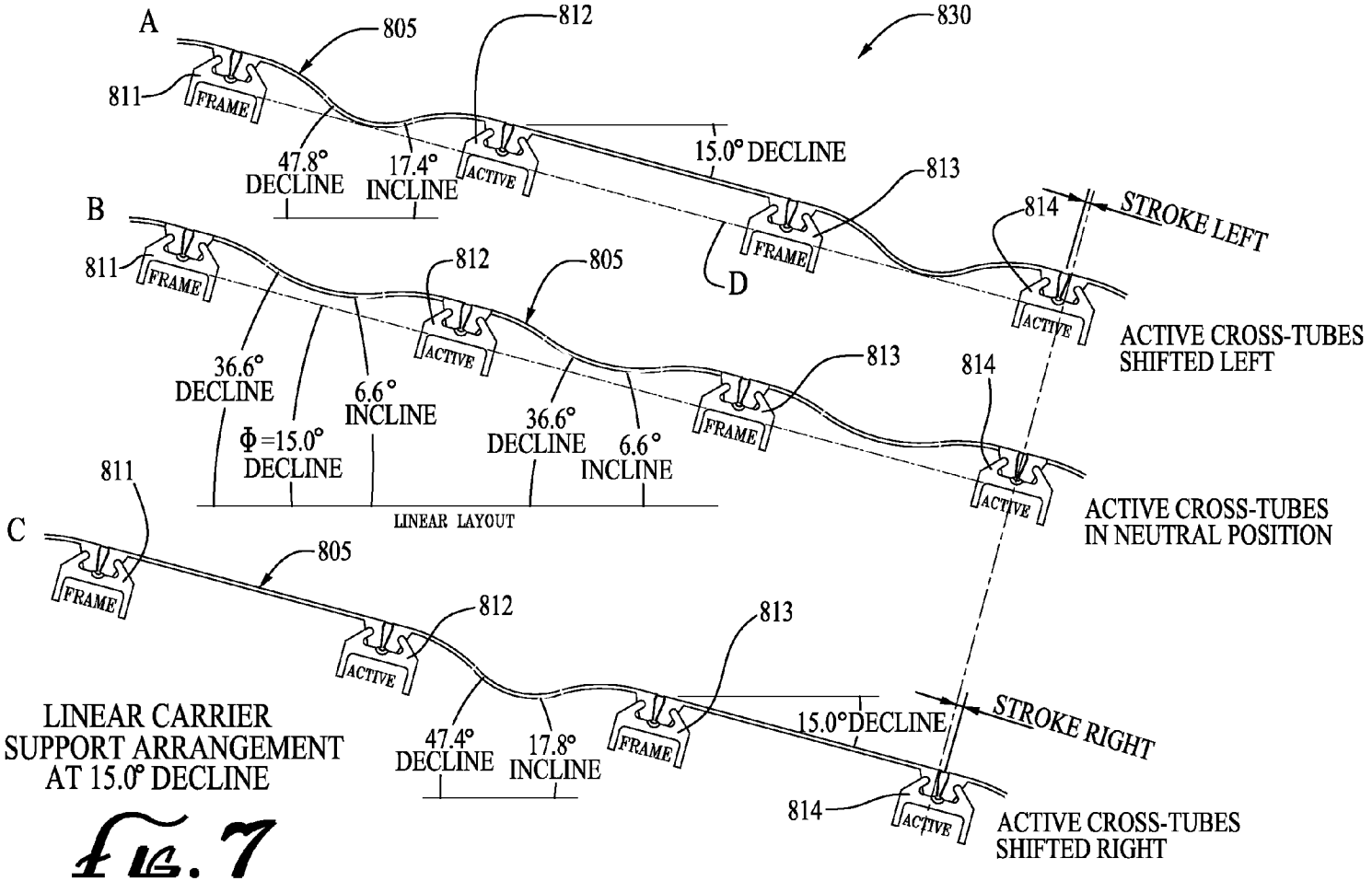
FIG. 7 is a schematic side view of a portion of the flip-flow screen and screen carrier supports, illustrating three positions of the balancer supports, the carrier supports being in a planar/linear arrangement, the screen being arranged at a 15 degree decline.

FIG. 7 illustrates a non-offset system whereby the arrangement 800 of the frame tubes and the balancer tubes is planar/linear, that is, all of the support tubes 811, 812, 813, 814 are arranged along the same 15° decline D. The elements in FIG. 7 bear the same numerals as in FIG. 5, only the declination angles are changed. FIG. 5 shows three flex positions (A, B and C) for a sieve mat 802. In position B, the balancer (active) tubes 812, 814 are in a neutral or more central position, thus each mat section is in a sagging condition, forming about a 6.6° incline approaching either the frame tubes 811, 813 or the balancer (active) tubes 812, 814. In position A, the balancer (active) tubes 812, 814 are shifted left creating about a 17.4° incline to the balancer tubes and an 15° decline to the frame tubes 811, 813. In position C, the balancer tubes 812, 814 are shown shifted right creating about 17.8° incline to the frame tubes 811, 813 and a 15° decline to the balancer tube.

Figure 8:
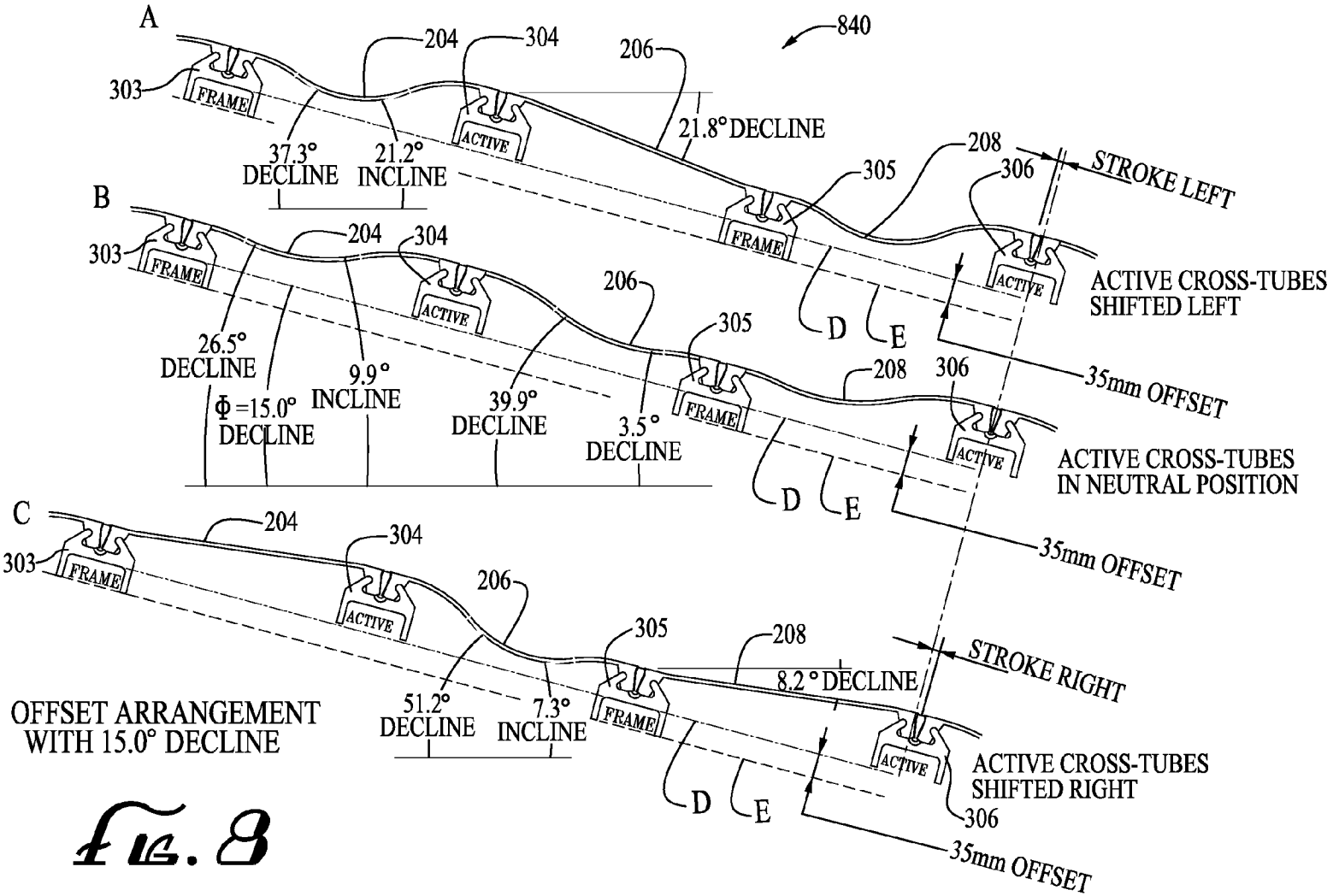
FIG. 8 is a schematic side view of a portion of the flip-flow screen and screen carrier support arrangement according to a second embodiment, illustrating three positions of the balancer supports, the balancer supports being in an offset arrangement from the frame carrier supports, the screen being arranged at a 15 degree decline.
Figure 9:
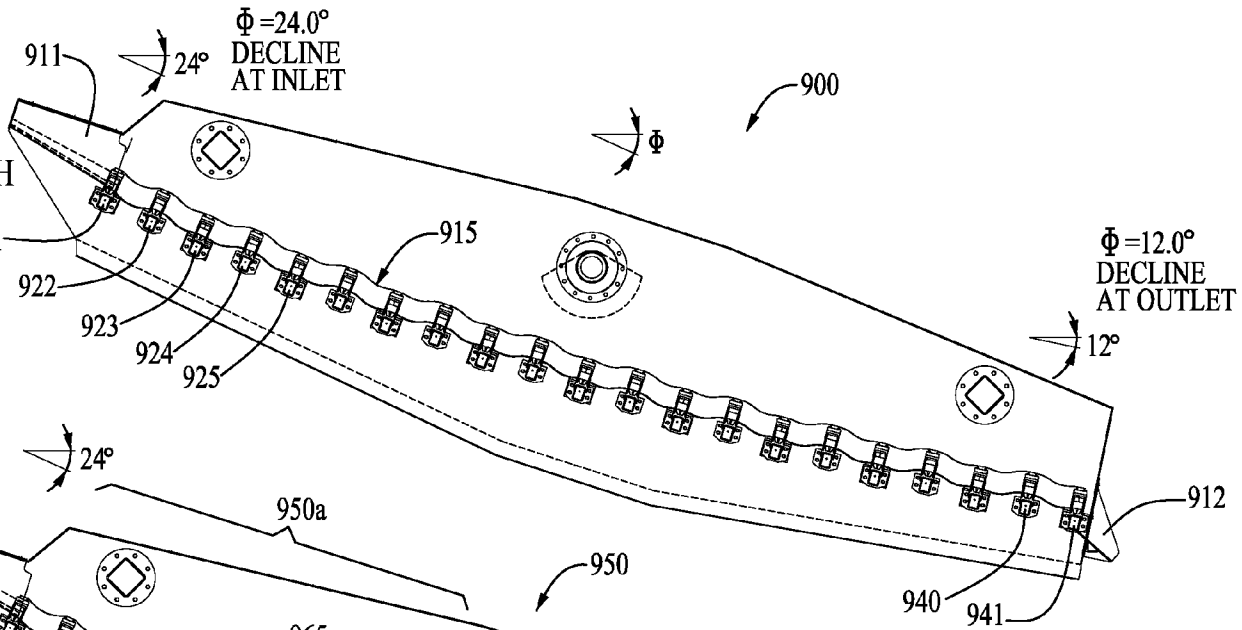
FIG. 9 is a diagrammatic cross-sectional side view of a flip-flow apparatus with the frame carrier supports in an offset configuration according to a third embodiment.

FIG. 8 illustrates a modified carrier tube configuration 840 according to a second embodiment with offset cross tubes. The elements in FIG. 8 bear the same numerals as in FIG. 6, only the declination angles are changed. The arrangement 840 also has a general 15° decline D for the balancer tubes

304, 306, but the frame tubes 303, 305 are downwardly offset by about 35 mm along a parallel 15° decline E below the decline D of the balancer tubes 304, 306. FIG. 8 shows three flex positions (A, B and C) for the sieve mat 200 (and the respective sieve mat sections 204, 206, 208). In position B, the balancer (active) tubes 304, 306 are in a neutral or more central position, thus each mat sections 204, 206, 208 are in a sagging condition, but the angle approaching the frame tubes 303, 305 is a 3.5° decline (as compared to a 6.6° incline to the frame tube in the non-offset configuration 830 of FIG. 7), and the angle approaching the balancer tubes 304, 306 is a 9.9° incline (as compared to the 6.6° incline to the balancer tube in the non-offset configuration 830 of FIG. 7). In position A, the balancer (active) tubes are shown shifted left, then the mat section 206 is stretched flat with an angle approaching the frame tube 305 is at a 21.8° decline (as compared to a 15° decline to the frame tube in the non-offset configuration 830 of FIG. 7); and the angle approaching the balancer tubes 304, 306 is at a 21.2° incline (as compared to the 17.4° incline to the balancer tube in the non-offset configuration 830 of FIG. 7). In position C, the balancer tubes 304, 306 are shown shifted right then the mat sections 204, 208 are stretched flat with an angle approaching the frame tube 305 is at a 7.3° incline (as compared to a 17.8° incline to the frame tube in the non-offset configuration 830 of FIG. 7), and the angle approaching the balancer tubes 304, 306 is at an 8.2° decline (as compared to the 15° decline to the balancer tube in the non-offset configuration 830 of FIG. 7).

As illustrated in the following Table 1, the angle of the mat approaching frame tube is at a greater decline at positions A, B and at a lesser incline at Position C:

TABLE 1

| Angle of mat approaching frame tube for 18° and 15° decline machines | | | |
|---|---|---|---|
| | Neutral Position B | Left Position A | Right Position C |
| General Decline: 18° (from FIGS. 5-6) | | | |
| Non-offset | 3.6° incline | 18° decline | 14.8° incline |
| 35 mm Offset | 6.5° decline | 24.8° decline | 4.3° incline |
| Declination Increase with Offset | 10.1° | 6.8° | 10.5° |
| General Decline: 15° (from FIGS. 7-8) | | | |
| Non-offset | 6.9° incline | 15° decline | 17.8° incline |
| 35 mm Offset | 3.5° decline | 21.8° decline | 7.3° incline |
| Declination Increase with Offset | 10.4° | 6.8° | 10.5° |

As shown in Table 1, the angle of the mat approaching the frame tube is at a greater decline at each of positions A, B and C (the lesser incline at Position C being a greater decline) for both the 18° and 15° machine configurations. Since the frame tube experiences a lesser stroke vibration than the balancer tube, the increased decline (or decreased incline) of the mat section approaching the frame tube in the offset configuration provides for greater material velocity at the frame tube positions and reduces or eliminates collecting or stacking of material at that position. These improved declination angles at the frame tubes result in a dramatic percentage improvement in slope. These steeper declination angles (or the less steep inclination angles) at the frame tubes enhance material travel speeds at those locations. This magnitude of change in angle is substantial. At the A position, declination at the offset frame tube is 138% of the declination of the non-offset frame tube. Similarly, at the C position, the incline at the offset frame tube becomes a mere 29% of what it is for the non-offset carrier. These percentages are significant, particularly for such a precision machine where a 1 mm difference in mat tension has noticeable effect on material movement.

Though mat angles approaching the balancer tubes have a decreased declination in the offset configuration, the greater stroke vibration of the balancer tubes, in practice, performs adequately to move the material by the balancer tube positions without increased burden depth.

Moreover, comparing the Right Position C, the 15° machine with the offset configuration has only a 7.3° incline, much lower than even the 18° machine of the non-offset configuration which has a 14.8° incline. Thus the 15° machine with offset compares favorably with the steeper 18° non-offset machine.

It is noted that when referring to the arrangement of the frame tubes 303, 305, etc. being arranged linearly along plane/line E, and the arrangement of the balancer tubes 304, 306 being arranged linearly along plane/line D, that linearity is referenced longitudinally down the length of the machine. The lateral ends 200*a*, 200*b* of the mat 200 are optionally upwardly raised, as shown in FIGS. 3 and 4. Thus the frame tube and the side of the mat section connected thereto are downwardly offset.

It is noted that in the machine 10 of FIGS. 1-4, each of the frame tubes 303, 305, 307 . . . 321 (and except for frame tube 301) is shown in a lowered offset position relative to the adjacent balancer tubes. Various alternative arrangements may be possible such as having only some (e.g., a majority) of the frame tubes offset (for example, some of the frame tubes, such as frame tubes 303-311, being non-offset, with frame tubes 313-321 being offset, or vice-versa) or a selected portion offset (such as a randomly spaced number of frame tubes), or the frame tubes may have different offsets (such as frame tubes 303-311 having a 25 mm offset and frame tubes 313-321 having a 38 mm offset or any other suitable arrangement).

The offset carrier tube configurations may also be applied to flip-flow machines having the alternate drive systems (e.g., where both first and second carrier supports are driven) where the first set of carrier supports exhibits a significantly lower stroke than the second carrier supports.

Though the embodiments of FIGS. 6 and 8 illustrate offsets carrier supports as applied to flat deck screens, the offset or lowered frame tube positions may be applied to other flip-flow machine configurations such as curved deck screens. FIG. 9 illustrates a flip-flow machine 900 of an alternate configuration with a non-linear (non-flat planar) tube arrangement. The machine 900 is tilted along a general or an average declination angle $\phi$ to the horizontal, and the carrier tubes 921, 922, 923 . . . 940, 941 (and thus the mat 915) are arranged at a (constant) declining declination angle from the upper inlet end 911 to the lower outlet end 912 (also may be referred to as a banana slope). The machine 900 is shown with a starting slope of ⅓ greater (e.g., 24°) than the average slope $\phi$ (e.g., $\phi$=18°) and an ending slope of ⅓ less (e.g., 12°) than the average slope $\phi$. Each of the frame tubes 923, 925, 927 . . . 941 (except for the first tube 921) is downwardly offset relatively from the adjacent balancer tubes 922, 924 . . . 940.

Also, it is noted that the example machines described above include only a single deck (i.e., only one mat 200), but other configurations are possible. An alternate machine may include multiple decks, with additional flip-flow or rigid type deck(s), one arranged above/below the other. Machines may also be provided with rigid or flexible hooding (such as hooding 17 shown in FIGS. 3-4).

Figure 10:
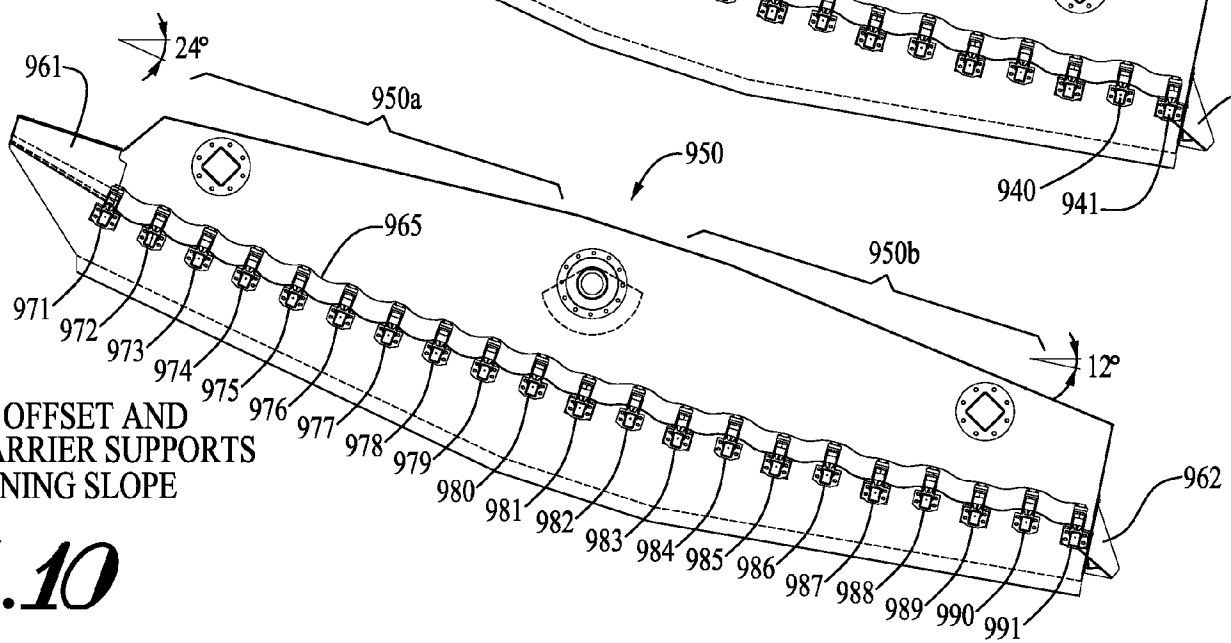
FIG. 10 is a diagrammatic cross-sectional side view of a flip-flow apparatus with a portion of the frame carrier supports in an offset configuration according to a fourth embodiment.

The various embodiments disclosed may be combined together or separately utilized. For example, FIG. 10 illustrates flip-flow machine 950 of another alternate configuration for a non-linear (non-planar) tube arrangement. The machine 950 is tilted along a general or an average declination angle ϕ to the horizontal, but along a declining declination angle (banana slope) from the upper inlet end 961 to the lower outlet end 962. In this machine 950, the upper section 950*a* of carrier tubes 971, 972, 973 . . . 980 are arranged along a declining declination angle from the upper inlet end 961, but the upper section frame tubes 973, 975, 977, 979 are non-offset to the adjacent balancer tubes 972, 974, 976 . . . 980. At the lower section 950*b* of the machine, the frame tubes 981, 983, 985 . . . 991 are downwardly offset relatively from adjacent balancer tubes 982, 984 . . . 990. Alternately, sections of the machine (e.g., upper section 950*a*) may be a linear slope (non-banana slope) configuration, while other sections (e.g., lower section 950*b*) may be a different type of slope configuration such as the banana slope illustrated.

Thus at a given section (or the whole) of the apparatus, ignoring the upwardly curved side edges (if provided), a portion (or all) of first carrier supports may be described as arranged along a first plane, and a corresponding portion (or all) of second carrier supports may be described as arranged along a second plane. In the non-offset examples of FIGS. 5 and 7, the first and second planes are the same. These planes may be straight (linear) as in the embodiments shown in FIGS. 2, 6 and 8, or these planes may be curved as in the embodiments shown in FIGS. 9 and 10.

Regardless of the deck type or drive system, the present inventor has found it desirable to optimize deck geometry, which in certain embodiments may include downwardly offsetting the lower acceleration/stroke carrier supports relative to the higher acceleration/stroke carrier supports. Thus, of the pair of first and second mat supports, design may be optimized by arranging at least some of the first mat supports at a lowered offset position relative to adjacent second mat supports such that downslope of the mat section approaching the first mat supports is increased relative to downslope of the mat section approaching the second mat support to compensate for the lower acceleration/stroke experienced by the first mat supports.

Examples of quantifying such offsets are set forth in the following.

Flat Deck Machines:

For a flat deck machine, the first carrier supports (such as the frame tube, e.g., 303, 305) are arranged on a first (flat) plane. The second carrier supports (such as the balancer tubes, e.g., 302, 304) are arranged on a second (flat) plane parallel to the first plane. The first and second planes need not be arranged parallel, but such a parallel arrangement may simplify construction/design. An example flat deck machine may have a spacing (or distance) between the first plane and the second plane of about 4.9% of first carrier support spacing (which would correspond to a 35 mm offset for a screening machine with a 710 mm spacing between an adjacent pair of first carrier supports 303, 305); or alternately greater than about 2.5% of the spacing between an adjacent pair of first carrier supports (which would correspond to an 18 mm offset for a screening machine with a 710 mm first carrier support spacing); or alternately, in a range of between about 1% to 8% which would correspond to an offset in the range of 7.1 mm to 57 mm for a 710 mm first carrier support spacing. Actual offsets may be selected depending upon machine size, design and configuration, among other factors.

Curved Deck Machines:

For a curved deck machine with (for example) a constant radius of curvature, the first carrier supports may be arranged within a curved plane or arc of a given radius and the second carrier supports then arranged within a second curved plane or arc of the same radius, these curved planes/arcs being offset. Where offset arcs have the same radius of curvature, they may be described as being arranged in parallel. Alternately, the declination or arc radius need not be constant. In a curved deck machine, any adjacent (parallel) pair of first carrier supports (e.g., 923, 925) form a first flat plane, and a corresponding adjacent (parallel) pair of second carrier supports (e.g., 922, 924) form a second flat plane. An example curved deck machine may have a spacing between the first flat plane and the second flat plane (measured perpendicularly) of about 4.9% (for a 35 mm offset on a 710 mm first carrier support spacing); or alternately greater than about 2.5% of the spacing between adjacent first carrier supports (e.g., 923, 925) (which would correspond to a 18 mm offset for a screening machine with a 710 mm first carrier support spacing); or in a range of between about 1% to 8%. Actual offsets may be selected depending upon machine size, design and configuration, among other factors.

In order to facilitate construction and implementation of the offset system, the construction may be provided with a structure whereby the frame tubes may be readily selected/installed in either the offset or non-offset configuration. For example, in a bolted connection structure for the connector 42, the main support frame section 40 may be constructed with multiple hole sets, a first hole set aligned for (bolted) attachment of the frame tube assembly in the offset position, and a second hole set aligned for (bolted) attachment of the frame tube assembly in the non-offset position.

The above-described offset carrier support configurations may provide one or more of the following advantages:

- Improved screening action by reduction of material stacking/collecting at the frame tube locations.
- Offset mat support configurations may reduce strain and stress levels for a given rubber shear block design when compared to non-offset configurations. One embodiment with taut screens mats and a 35 mm mat support offset may effectively allow a reduction in rubber shear stroke by 4 mm (from 17 m peak to peak stroke) and resultant reduction in strain on the order of 23% (4 mm/17 mm). In the aforementioned example, component life may be greatly increased (expected that the increase may be a factor on the order of up to 6× depending upon operating conditions). Furthermore, a reduction in strain may reduce rubber shear and flexible screen mat failure rates in extreme overstroke conditions.
- May permit a lower overall machine declination angle ϕ for a given machine and yet achieve comparable or improved screening results.
- May minimize "dead" area at frame tube members for maximum screen open area and efficiency.
- Less collecting/stacking of material at the frame tube locations may further result in improved screening accuracy (due to less material tipping), higher capacity, and improved screening efficiency.
- May be preferred for screening action of certain material streams, such as shredded automotive materials, but for certain other materials the non-offset carrier support configuration may be preferred.

While the inventions have been particularly shown and described with reference to certain embodiments, it will be understood by those skilled in the art that various changes in form and detail may be made without departing from the spirit and scope of the invention.

The invention claimed is:

1. A flip-flow type screening apparatus comprising
a plurality of first mat supports;
a plurality of second mat supports;
a sieve mat comprising a plurality of sieve mat sections, wherein each sieve mat section is supported between an adjacent pair of mat supports comprising a first mat support and a second mat support;
a drive apparatus imparting a vibration to the apparatus whereby the second mat supports are translated relative to the first mat supports,
wherein a first plane formed by at least a portion of the first mat supports is structurally arranged, independent of support translation, at a lowered offset relative to a second plane formed by a corresponding portion of the second mat supports.

2. An apparatus according to claim 1 wherein the lowered offset is greater than about 2.5% of a spacing between adjacent first mat supports.

3. An apparatus according to claim 1 wherein the lowered offset is in a range of between about 1% to 8% of a spacing between adjacent first mat supports.

4. An apparatus according to claim 1 wherein the first mat supports are arranged along a first arc of a given radius and wherein the second mat supports are arranged along a second arc of the given radius, wherein the first arc is at a lowered offset position to the second arc of the second mat supports.

5. An apparatus according to claim 1 wherein the first mat supports are positioned along an arc of a given radius.

6. An apparatus according to claim 1 wherein at least a portion of the first mat supports is arranged along a declining declination angle.

7. An apparatus according to claim 1 wherein the sieve mat section is constructed and arranged to be alternately tensioned and relaxed in a flip-flow action via relative movements of the first and second mat supports.

8. A screening or conveying apparatus, comprising
a base;
a frame assembly comprised of a main support frame section mounted on the base;
a plurality of first mat supports and a plurality of second mat supports spaced from each other and arranged transversely to a length of the frame assembly;
a drive assembly for imparting a vibration to the main support frame section;
a flexible mat comprised of a plurality of flexible mat sections, each mat section being supported between an adjacent pair of alternating first and second mat supports, wherein an adjacent pair of first and second mat sections are supported by a common mat support;
wherein the common mat support comprises a cross member extending substantially across a transverse width of the first and second mat sections;
wherein the first mat supports are mounted to and vibrate with the main support frame section and wherein the second mat supports are movably mounted to the main support frame section for allowing an adjacent pair of first and second mat supports to be movable relative to each other for causing the flexible mat section supported therebetween to be alternately tensioned and relaxed in a flip-flow action via movement of the second mat support relative to the first mat support adjacent thereto;
wherein a group of the first mat supports is structurally arranged, independent of support movement, at a lowered offset position relative to a group of adjacent second mat supports.

9. An apparatus according to claim 8 wherein the group of first mat supports are arranged in a first flat plane and wherein the second mat supports are arranged in a flat second plane, wherein the first flat plane is at a lowered offset position parallel to the second flat plane of second mat supports.

10. An apparatus according to claim 8 wherein the second mat supports are mounted via a movable mount to the main support frame section for allowing the second mat support to be movable relative to its adjacent first mat support, wherein the movable mount comprises a plurality of shear mounts of elastomeric material.

11. An apparatus according to claim 8 wherein a plurality of the first mat supports are in a lowered offset position relative to the second mat supports.

12. An apparatus according to claim 8 wherein the first mat supports are positioned along an arc of a given radius.

13. An apparatus according to claim 8 wherein at least a portion of the first mat supports is arranged along declining declination angle.

14. In a flip-flow type screening or conveying apparatus including a main support frame section, a drive assembly for imparting a vibration to the main support frame section, a transport mat and mat support system, the transport mat and mat support system comprising:
a plurality of first mat supports and a plurality of second mat supports spaced from each other and arranged transversely to a length of the main support frame section;
a flexible mat comprised of a plurality of flexible mat sections, each mat section being supported between an adjacent pair of alternating first and second mat supports, wherein an adjacent pair of first and second mat sections are supported by a common mat support,
wherein the first mat supports are mounted to and vibrate with the main support frame section and the second mat supports are movably mounted to the main support frame section for allowing an adjacent pair of first and second mat supports to be movable relative to each other for causing the flexible mat section supported therebetween to be alternately tensioned and relaxed in a flip-flow action via movement of a second mat support relative to the first mat support adjacent thereto;
wherein a group of the first mat supports is structurally arranged, independent of mat support movement, at a lowered offset position relative to a group of adjacent second mat supports.

15. A method of screening or conveying materials using a flexible mat operated in a flip-flow type process, the flexible mat comprised of a plurality of flexible mat sections, each mat section being supported between an adjacent pair of alternating first and second mat supports, comprising the steps of
mounting the first mat supports to a main support frame section;
applying a vibration to the main support frame section;
movably mounting the second mat supports to the main support frame section for allowing an adjacent pair of first and second mat supports to be movable relative to each other for causing the flexible mat section supported therebetween to be alternately tensioned and relaxed in a flip-flow action via movement of the second mat support relative to the first mat support adjacent thereto;
structurally arranging, independent of mat support movement, at least some of the first mat supports at a lowered offset position relative to adjacent second mat supports such that downslope of the mat section approaching the first mat supports is increased relative to downslope of the mat section approaching the second mat support.

16. A method of material screening comprising the steps of providing a sieve mat with a plurality of sieve mat sections disposed consecutively along a length of a screening apparatus, each sieve mat section extending transversely between sides of the screening apparatus and being supported by a pair of first and second mat supports;

driving the machine so as to move one or both the first and second supports so as to alternately tension and relax the sieve mat section in a flip-flow action;

structurally arranging, independent of support movement, at least a group of the first mat supports at a lowered offset position relative to a corresponding adjacent group of the second mat supports.

17. A method according to claim 16 wherein the step of arranging comprises increasing downslope of the mat section approaching the first mat supports relative to downslope of the mat section approaching the second mat supports.

18. A method according to claim 16 further comprising reducing strain and stress levels experienced by shear mounts supporting at least a portion of the mat supports by reducing stroke of the mat support as compared to a non-offset configuration.

19. An apparatus according to claim 1 wherein a lowered offset is maintained throughout translation of the mat supports.

20. An apparatus according to claim 8 wherein a lowered offset is maintained throughout relative movement of the mat supports.

21. A transport mat and mat support system according to claim 14 wherein a lowered offset is maintained throughout relative movement of the mat supports.

22. A method according to claim 15 wherein a lowered offset is maintained throughout relative movement of the mat supports.

23. A method according to claim 16 wherein a lowered offset is maintained throughout relative movement of the mat supports.

24. A material screening apparatus comprising a plurality of first mat supports;

a plurality of second mat supports;

a sieve mat comprising a plurality of sieve mat sections, wherein each sieve mat section is supported between an adjacent pair of mat supports comprising a first mat support and a second mat support;

a drive system operative to move one or both the first and second supports so as to alternately increase and decrease distance between an adjacent pair of mat supports, wherein a first plane formed by at least a portion of the first mat supports is vertically offset, irrespective of support movement, relative to a second plane formed by a corresponding portion of the second mat supports.

25. A material screening apparatus comprising a plurality of first mat supports;

a plurality of second mat supports;

a sieve mat comprising a plurality of sieve mat sections, wherein each sieve mat section is supported between an adjacent pair of mat supports comprising a first mat support and a second mat support;

a drive system operative to move one or both the first and second supports so as to alternately increase or decrease contract distance between an adjacent pair of mat supports, wherein a first plane formed by at least a portion of the first mat supports is arranged and maintained, throughout any relative movement of the mat supports, at a vertical offset relative to a second plane formed by a corresponding portion of the second mat supports.

26. A material screening apparatus comprising a plurality of adjacent pairs of mat supports, each adjacent pair comprising a first mat support and a second mat support;

a sieve mat comprising a plurality of sieve mat sections, wherein each sieve mat section is supported between an adjacent pair of the mat supports;

a drive system operative to move at least one of the mat supports of an adjacent pair so as to alternately increase and decrease distance between the adjacent pair of mat supports, wherein a set of first mat supports is arranged in a first plane and a corresponding set of second mat supports is arranged in a second plane that is vertically offset from the first plane, regardless of relative positions of the mats supports during operation of the drive system.

27. A material screening apparatus according to claim 26 wherein the first and second planes comprise curved, non-flat planes.

* * * * *

UNITED STATES PATENT AND TRADEMARK OFFICE

CERTIFICATE OF CORRECTION

PATENT NO. : 8,757,392 B2
APPLICATION NO. : 13/671385
DATED : June 24, 2014
INVENTOR(S) : Andrew T. LaVeine It is certified that error appears in the above-identified patent and that said Letters Patent is hereby corrected as shown below:

IN THE SPECIFICATION

Column 3
Line 66, change "surround and prevent/inhibit" to --surrounds and prevents/inhibits--.

Column 7
Line 22, change "pulling taught" to --pulling it taut--.

Column 8
Line 24, after "each" insert --of the--.
Line 25, change "are" to --is--.
Line 33, before "is" insert --that--.
Line 41, before "is" insert --that--.

Column 9
Line 7, after "each" insert --of the--.
Line 7, change "are" to --is--.
Line 16, before "is" insert --that--.
Line 23, before "is" insert --that--.

IN THE CLAIMS

Column 16
Lines 17-18, after "decrease" delete "contract".

Signed and Sealed this
Twenty-fourth Day of November, 2015

Michelle K. Lee

Michelle K. Lee
*Director of the United States Patent and Trademark Office*